US008992256B2

(12) United States Patent
Chen et al.

(10) Patent No.: US 8,992,256 B2
(45) Date of Patent: Mar. 31, 2015

(54) ELECTRICAL CONNECTOR ADAPTER

(71) Applicant: Ting-Chi Chen, New Taipei (TW)

(72) Inventors: Ting-Chi Chen, New Taipei (TW); Su-Yung Chou, New Taipei (TW); Yi-Chieh Lin, New Taipei (TW); Te-Fu Lu, New Taipei (TW)

(73) Assignee: Ting-Chi Chen, New Taipei (TW)

( * ) Notice: Subject to any disclaimer, the term of this patent is extended or adjusted under 35 U.S.C. 154(b) by 0 days.

(21) Appl. No.: 14/090,896

(22) Filed: Nov. 26, 2013

(65) Prior Publication Data

US 2015/0044892 A1 Feb. 12, 2015

(30) Foreign Application Priority Data

Aug. 7, 2013 (TW) ..... 102128346 A

(51) Int. Cl.
*H01R 13/648* (2006.01)
*H01R 29/00* (2006.01)

(52) U.S. Cl.
CPC ..... *H01R 29/00* (2013.01)
USPC ..... 439/607.23

(58) Field of Classification Search
CPC ..... H01R 23/6873; H01R 13/658
USPC ..... 439/607.23–607.56
See application file for complete search history.

(56) References Cited

U.S. PATENT DOCUMENTS

| | | | | |
|---|---|---|---|---|
| 6,319,063 | B1 * | 11/2001 | Huang | 439/607.36 |
| 7,811,110 | B2 * | 10/2010 | He et al. | 439/218 |
| 8,123,562 | B2 * | 2/2012 | Zhou et al. | 439/607.48 |
| 2011/0159732 | A1 * | 6/2011 | Kondo et al. | 439/607.01 |
| 2014/0315431 | A1 * | 10/2014 | Pocrass | 439/607.01 |

* cited by examiner

*Primary Examiner* — Phuongchi T Nguyen
(74) *Attorney, Agent, or Firm* — Muncy, Geissler, Olds & Lowe, P.C.

(57) ABSTRACT

An electrical connector adapter includes an electrical insulating terminal holder including a holder body defining a plurality of elongated openings and an abutment surface, a front extension and a front tongue, a conducting terminal set including conducting terminals suspending in the elongated openings, transmission terminals supported on the abutment surface, signal terminals formed integral with the transmission terminals and suspending in the front extension and mating terminals formed integral with the conducting terminals and suspending in the front tongue, and an EMI shielding shell including a main shell part surrounding the holder body, a first sub shell part surrounding the front extension and a second sub shell part surrounding the front tongue. Thus, the electrical connector adapter saves much installation space, facilitates convenient use without causing interference, and provides a wide range of applications.

10 Claims, 13 Drawing Sheets

ELECTRICAL CONNECTOR ADAPTER

This application claims the priority benefit of Taiwan patent application number 102128346, filed on Aug. 7, 2013.

BACKGROUND OF THE INVENTION

1. Field of the Invention

The present invention relates to electrical connectors, and more particularly to an electrical connector adapter, which an electrical insulating terminal holder having a front extension of reduced size extended from a holder body thereof, a conducting terminal set including conducting terminals suspending in the holder body, transmission terminals suspending in the front extension, and an EMI shielding shell surrounding the holder body and the front extension for enabling the electrical connector adapter to provide a wide range of applications.

2. Description of the Related Art

Following fast development of computer electronic technology, many high mobility electrical and electronic apparatus are well developed and widely used by people for different applications, bringing convenience to people and making people's life more comfortable. Further, high-speed, high-power and sophisticated mobile electrical and electronic devices and related products with large capacity and low profile characteristics have been continuously created. Further, many different transmission interfaces and connectors are widely used in electrical and electronic products for power and data transmission. For connecting different component parts, various transmission interfaces or connectors of different sizes and configurations must be used. Therefore, an electrical or electronic device needs to provide sufficient installation space for the installation of different types of transmission interfaces and connectors.

Further, it is the market trend to create mobility electronic apparatuses having light, thin, short and small characteristics. In consequence, circuit board electronic components must be made extremely strong, small and precise. Further, many different male and female electrical connectors are used in an electronic apparatus to connect different components and parts to a circuit board for the connection of mating electronic cards and/or connectors. These electrical connectors occupy much circuit layout space of the circuit board and the inside space of the electronic apparatus. It is quite important to fully utilize the circuit layout space of a circuit board and the internal space of an electronic apparatus.

SUMMARY OF THE INVENTION

The present invention has been accomplished under the circumstances in view. It is one object of the present invention to provide an electrical connector adapter, which requires less installation space and provides a wide range of applications.

To achieve this and other objects of the present invention, an electrical connector adapter in accordance with one embodiment of the present invention comprises an electrical insulating terminal holder, a conducting terminal set, and an EMI (electromagnetic interference) shielding shell. The electrical insulating terminal holder comprises a holder body defining a plurality of elongated openings and an abutment surface, a front extension forwardly extended from a lower part of the front side of the holder body, and an accommodation open space defined in the front extension. The front extension is configured relatively smaller than the holder body in width and height. The conducting terminal set is mounted in electrical insulating terminal holder, comprising a plurality of conducting terminals and a plurality of transmission terminals. Each conducting terminal comprises a mating contact end portion located at a front end thereof and suspending in one elongated opening, and a bonding end portion located at an opposite rear end thereof and extended out of the rear side of the holder body. Each transmission terminal comprises a mating contact end piece located at a front end thereof and suspending in the accommodation open space of the electrical insulating terminal holder, and a bonding end piece located at an opposite rear end thereof and extended out of the rear side of the holder body. The EMI shielding shell surrounds the electrical insulating terminal holder, comprising a main shell part, a main accommodation chamber defined in the main shell part and accommodating the holder body of the electrical insulating terminal holder, a first sub shell part forwardly extended from a front bottom side of the main shell part, and a first sub accommodation chamber defined in the first sub shell part and accommodating the front extension of the electrical insulating terminal holder. The first sub shell part is configured relatively smaller than the main shell part in width and height.

Further, the holder body of the electrically insulative terminal holder is configured to fit one of USB3.0, USB2.0 and HDMI specifications. Further, the front extension of the electrical insulating terminal holder is configured to fit one of Micro USB3.0, Micro USB2.0 and Mini HDMI specifications.

To achieve this and other objects of the present invention, an electrical connector adapter in accordance with another embodiment of the present invention comprises an electrical insulating terminal holder, a conducting terminal set, and an EMI (electromagnetic interference) shielding shell. The electrical insulating terminal holder comprises a holder body defining opposing front side and rear side, a plurality of elongated openings of different widths cut through opposing top and bottom walls of the holder body, an abutment surface disposed at a front side relative to the elongated openings, a front extension and a front tongue forwardly extended from the front side of the holder body, an accommodation open space defined in the front extension, and a plurality of terminal slots defined in the front tongue. The front extension and the front tongue are relatively smaller than the holder body in width and height. The conducting terminal set is mounted in the electrical insulating terminal holder, comprising a plurality of conducting terminals, a plurality of transmission terminals, a plurality of signal terminals, and a plurality of mating terminals. Each conducting terminal comprises a mating contact end portion located at a front end thereof and suspending in one elongated opening of the electrically insulating terminal holder, and a bonding end portion located at an opposite rear end thereof and extended out of the rear side of the holder body. Each transmission terminal comprises a mating contact end piece located at a front end thereof and supported on the abutment surface of the electrical insulating terminal holder, and a bonding end piece located at an opposite rear end thereof and extended out of the rear side of the holder body. The signal terminals are respectively extended from the transmission terminals and terminating in a front mating contact segment. The front mating contact segments of the signal terminals are suspended in the accommodation open space in the front extension. The mating terminals are respectively formed integral with and extended from the conducting terminals, and respectively terminating in a respective curved mating contact section. The curved mating contact sections of the mating terminals are respectively suspended in the terminal slots in the front tongue. The EMI shielding shell surrounds the electrical insulating terminal holder, comprising a main shell part, a main accommodation chamber defined in the main shell part and adapted for accommodating the holder body of the electrical insulating terminal holder, a first sub shell part and a second sub shell part forwardly extended from a front bottom side of the main shell part, a first sub accommodation chamber defined in the sub shell part and adapted for accommodating the front extension of the electrical insulating terminal holder, and a second sub accommodation chamber defined in the second sub shell part and adapted for accommodating the front tongue of the electrical insulating terminal holder.

Further, the elongated openings in the holder body of the electrical insulating terminal holder, the conducting terminals of the conducting terminal set and the main accommodation chamber in the main shell part of the EMI shielding shell are configured to fit USB3.0 connector; the abutment surface of the holder body of the electrical insulating terminal holder, the mating terminals of the conducting terminal set and the main accommodation chamber in the main shell part of the EMI shielding shell are configured to USB2.0 or HDMI connector; the front extension of the electrical insulating terminal holder, the signal terminals of the conducting terminal set and the first sub shell part of the EMI shielding shell are configured to fit Micro USB2.0 or Mini HDMI connector; the front tongue of the electrical insulating terminal holder, the mating terminals of the conducting terminal set and the second sub shell part of the EMI shielding shell are configured to fit Micro USB3.0.

DETAILED DESCRIPTION OF THE PREFERRED EMBODIMENT

Figure 1:
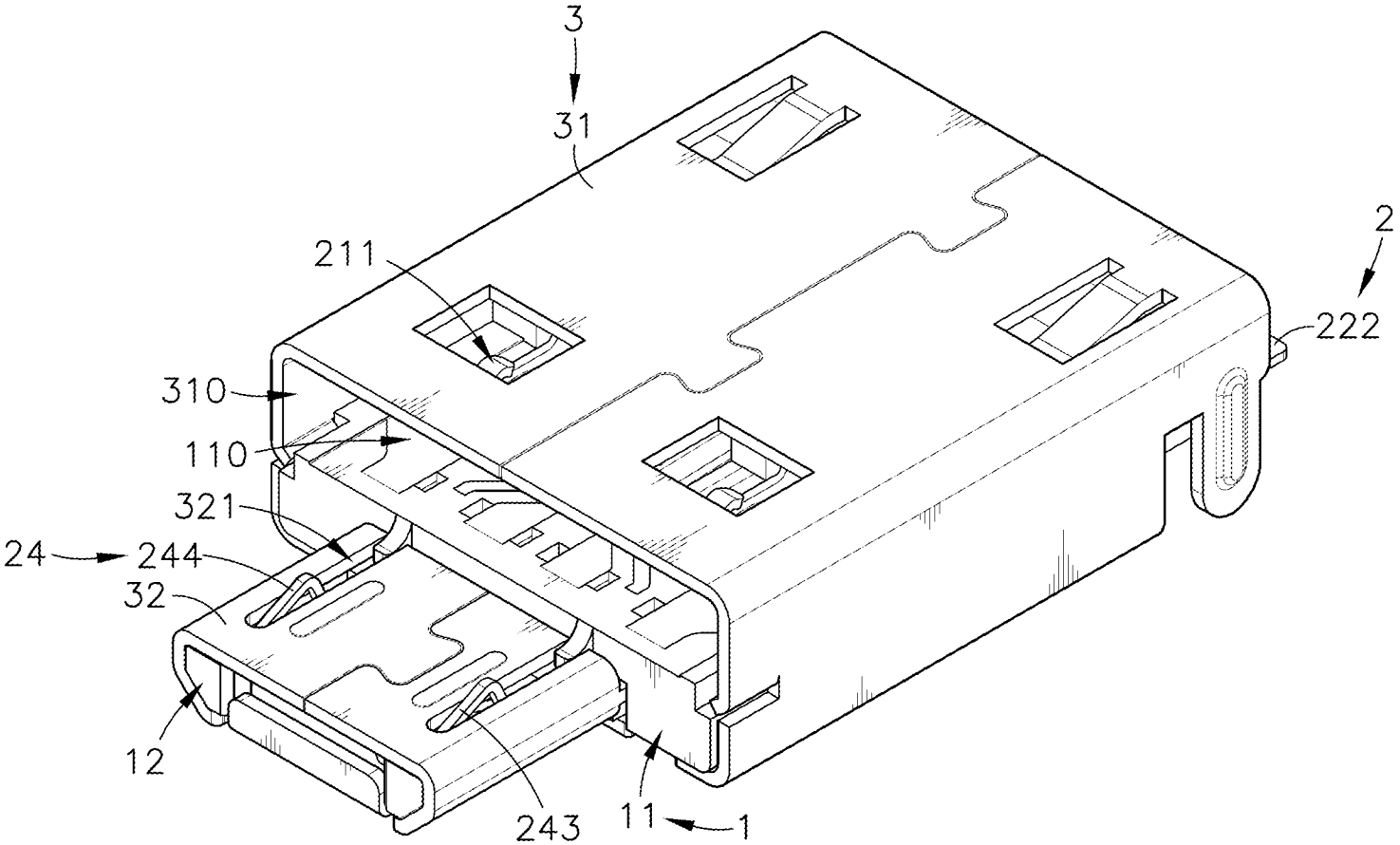
FIG. 1 is an oblique top elevation of an electrical connector adapter in accordance with a first embodiment of the present invention.
Figure 2:
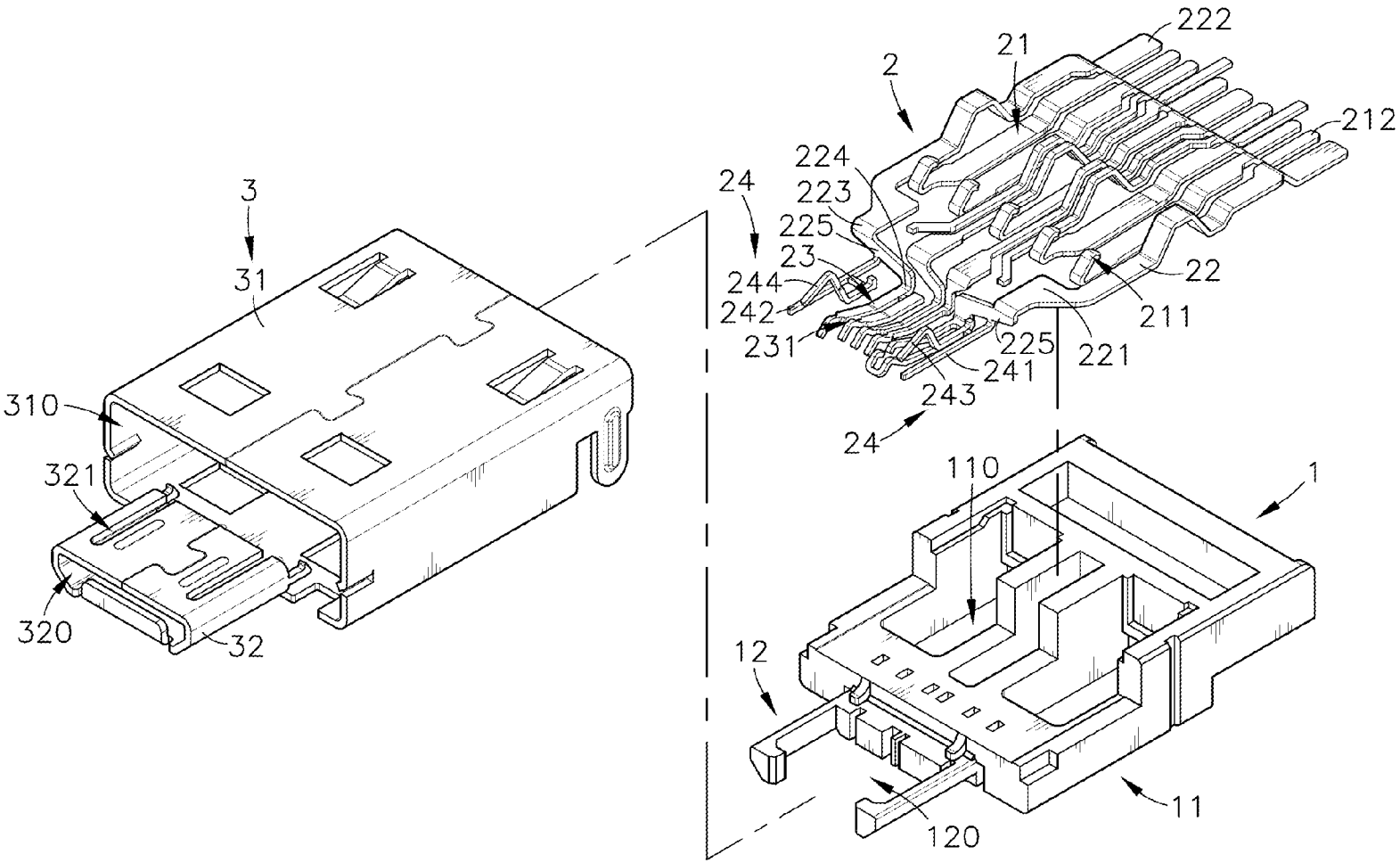
FIG. 2 is an exploded view of the electrical connector adapter in accordance with the first embodiment of the present invention.
Figure 3:
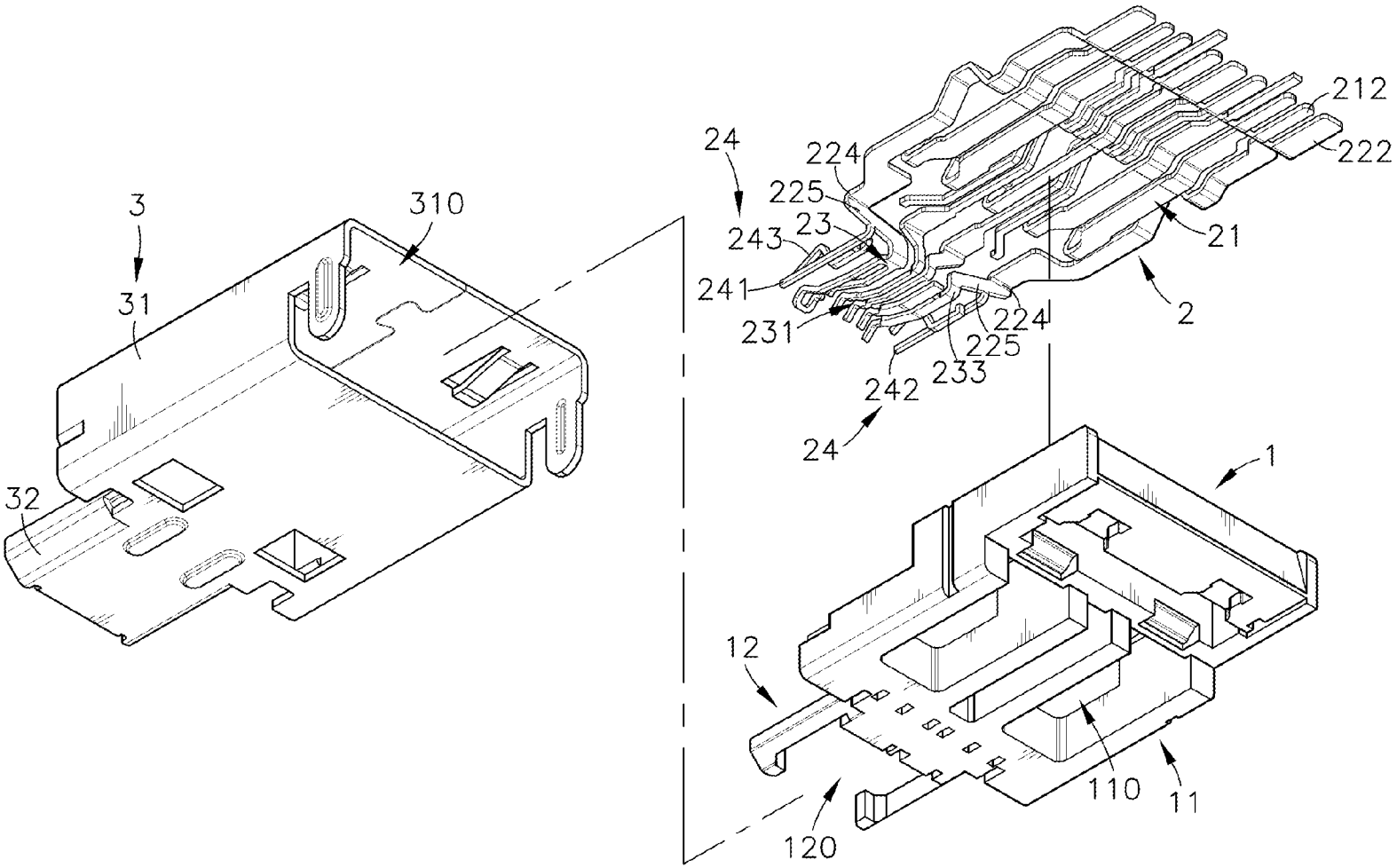
FIG. 3 corresponds to FIG. 2 when viewed from another angle.
Figure 4:
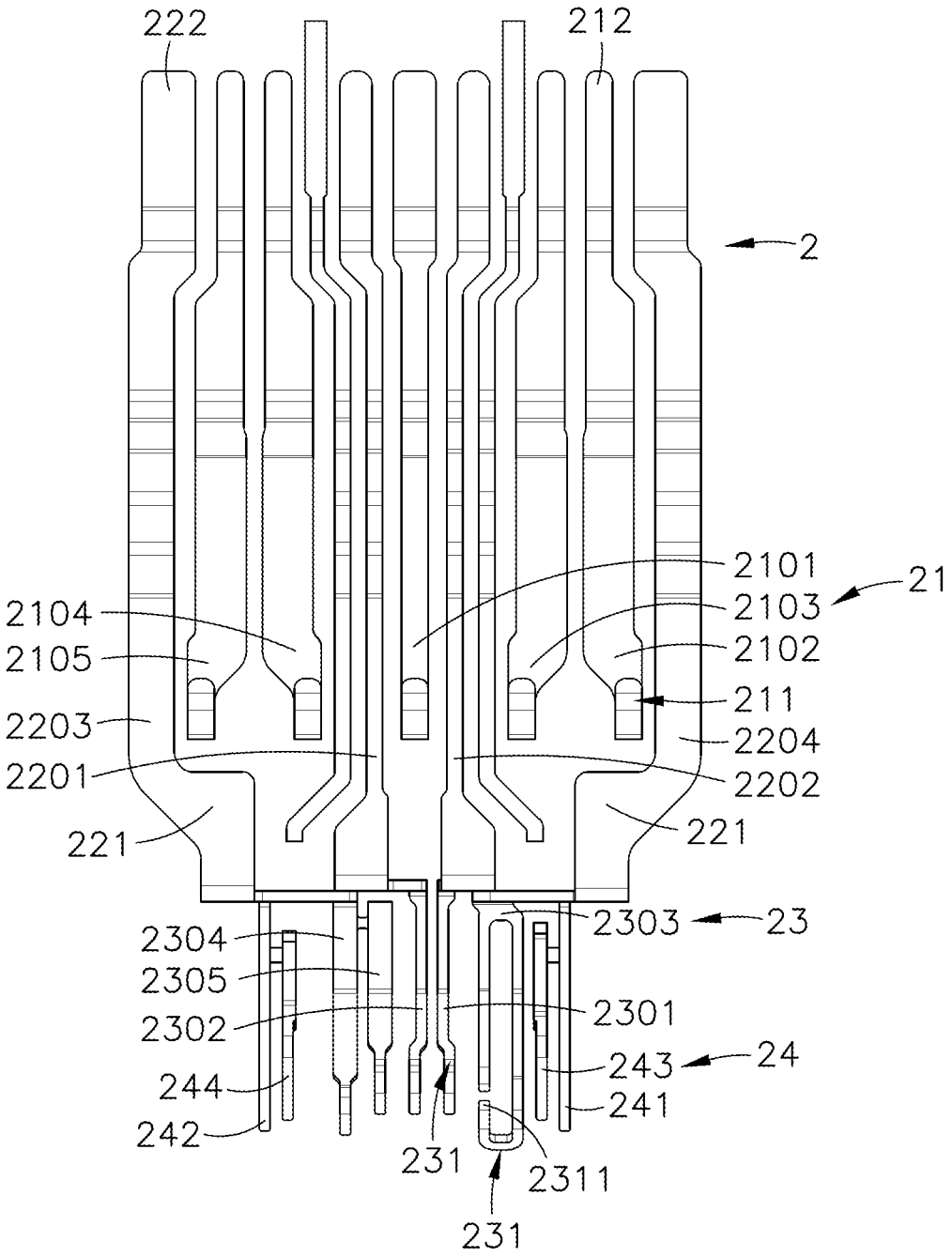
FIG. 4 is a top plain view illustrating the arrangement of the conducting terminal set of the electrical connector adapter in accordance with the first embodiment of the present invention.

Referring to FIGS. 1-4, an electrical connector adapter in accordance with a first embodiment of the present invention is shown. As illustrated, the electrical connector adapter in accordance with this first embodiment comprises an electrical insulating terminal holder 1, a conducting terminal set 2, and an EMI (electromagnetic interference) shielding shell 3.

The electrical insulating terminal holder 1 comprises a holder body 11, a plurality of elongated openings 110 cut through opposing top and bottom walls of the holder body 11, a front extension 12 forwardly extended from a lower part of a front side of the holder body 11, and an accommodation open space 120 defined in the front extension 12.

The conducting terminal set 2 comprises a plurality of conducting terminals 21, transmission terminals 22 and signal terminals 23. Each conducting terminal 21 comprises a mating contact end portion 211 located at a front end thereof, and a bonding end portion 212 located at an opposite rear end thereof. Each transmission terminal 22 comprises a mating contact end piece 221 located at a front end thereof, and a bonding end piece 222 located at an opposite rear end thereof. The signal terminals 23 are respectively formed integral with the mating contact end pieces 221 of the transmission terminals 22, i.e., the mating contact end piece 221 of each transmission terminal 22 is curved sideways in direction toward the longitudinal central axis of the electrical insulating terminal holder 1, and then bent vertically downwards and then forwards, and then horizontally terminating in one respective signal terminal 23.

The EMI shielding shell 3 comprises a main shell part 31, a main accommodation chamber 310 defined in the main shell part 31, a first sub shell part 32 forwardly extended from a front bottom side of the main shell part 31, and a first sub accommodation chamber 320 defined in the first sub shell part 32.

When assembling the electrical connector adapter, mount the conducting terminals 21 and the transmission terminals 22 in the electrical insulating terminal holder 1 in such a manner that the mating contact end portions 211 of the conducting terminals 21 are respectively suspended in the elongated openings 110 within the holder body 11, and the bonding end portions 212 of the conducting terminals 21 are respectively extended out of an opposing rear side of the holder body 11; the mating contact end pieces 221 of the transmission terminals 22 are respectively suspended in the accommodation open space 120 within the front extension 12, and the bonding end pieces 222 of the transmission terminals 22 are respectively extended out of the rear side of the holder body 11 in co-planar relationship to the bonding end portions 212 of the conducting terminals 21. Thereafter, attach the EMI shielding shell 3 to the electrical insulating terminal holder 1 to have the holder body 11 and front extension 12 of the electrical insulating terminal holder 1 be respectively accommodated in the main accommodation chamber 310 in the main shell part 31 and the first sub accommodation chamber 320 in the first sub shell part 32. At this time, the electrical insulating terminal holder 1, the conducting terminal set 2 and the EMI shielding shell 3 are assembled together, forming a predetermined first electrical connector (for example, USB3.0 connector, wherein the holder body 11 of the electrical insulating terminal holder 1, the transmission terminals 22 of the conducting terminal set 2 and the main shell part 31 of the EMI shielding shell 3 constitute a predetermined second electrical connector (for example, USB2.0 or HDMI connector); the front extension 12 of the electrical insulating terminal holder 1, the signal terminals 23 of the conducting terminal set 2 and the first sub shell part 32 of the EMI shielding shell 3 constitute a predetermined third electrical connector (for example, Micro USB or Mini HDMI connector).

Further, the width and height of the front extension 12 of the electrical insulating terminal holder 1 are relatively smaller than the width and height of the holder body 11. The width and height of the first sub shell part 32 of the EMI shielding shell 3 are relatively smaller than the width and height of the main shell part 31 of the EMI shielding shell 3. The main shell part 31 and first sub shell part 32 of the EMI shielding shell 3 are respectively configured to fit the holder body 11 and front extension 12 of the electrical insulating terminal holder 1. Thus, the holder body 11 of the electrical insulating terminal holder 1, the conducting terminals 21 of the conducting terminal set 2 and the main shell part 31 of the EMI shielding shell 3 can constitute a predetermined first electrical connector (for example, USB3.0 connector); the holder body 11 of the electrical insulating terminal holder 1, the transmission terminals 22 of the conducting terminal set 2 and the main shell part 31 of the EMI shielding shell 3 can constitute a predetermined second electrical connector (for example, USB2.0 or HDMI connector); the front extension 12 of the electrical insulating terminal holder 1, the signal terminals 23 of the conducting terminal set 2 and the first sub shell part 32 of the EMI shielding shell 3 can constitute a predetermined third electrical connector (for example, Micro USB or Mini HDMI connector).

Further, in this embodiment, the main shell part 31 and first sub shell part 32 of the EMI shielding shell 3 are integrally made in one piece. Alternatively, the main shell part 31 and the first sub shell part 32 can be separately made, and then bonded together by using a soldering, high frequency welding or spot gluing technique.

Further, the number of the conducting terminals 21 of the conducting terminal set 2 is 5, i.e., the $1^{st}$ grounding terminal 2101, the $1^{st}$ differential signal terminal 2102, the $2^{nd}$ differential signal terminal 2103, the $3^{nd}$ differential signal terminal 2104 and the $4^{th}$ differential signal terminal 2105, wherein the $1^{st}$ grounding terminal 2101 is arranged on the middle, the $1^{st}$ differential signal terminal 2102 and the $4^{th}$ differential signal terminal 2105 are arranged in parallel at two opposite lateral sides relative to the $1^{st}$ grounding terminal 2101, and the $2^{nd}$ differential signal terminal 2103 and the $3^{rd}$ differential signal terminal 2104 are arranged in parallel and respectively spaced between the $1^{st}$ grounding terminal 2101 and the $1^{st}$ differential signal terminal 2102 and $4^{th}$ differential signal terminal 2105. The number of the transmission terminals 22 is 4, i.e., the $5^{th}$ differential signal terminal 2201, the $6^{th}$ differential signal terminal 2202, the $1^{st}$ power terminal 2203 and the $2^{st}$ grounding terminal 2204, wherein the $5^{th}$ differential signal terminal 2201 and the $6^{th}$ differential signal terminal 2202 are arranged in parallel between the $1^{st}$ grounding terminal 2101 and the $2^{nd}$ differential signal terminal 2103 and the $3^{rd}$ differential signal terminal 2104; the $1^{st}$ power terminal 2203 and the $2^{nd}$ grounding terminal 2204 are arranged in parallel at two opposite lateral sides relative to the conducting terminals 21. The signal terminals 23 are respectively extended from the mating contact end pieces 221 of the transmission terminals 22, and classified as the $7^{th}$ differential signal terminal 2301, the $8^{th}$ differential signal terminal 2302, the $2^{nd}$ power terminal 2303 and the $3^{rd}$ grounding terminal 2304, wherein the $7^{th}$ differential signal terminal 2301 and the $8^{th}$ differential signal terminal 2302 are arranged in parallel on the middle; the $2^{nd}$ power terminal 2303 and the $3^{rd}$ grounding terminal 2304 are arranged in parallel at two opposite lateral sides relative to the $7^{th}$ differential signal terminal 2301 and the $8^{th}$ differential signal terminal 2302. The conducting terminal set 2 further comprises a supplementary transmission terminal 2305 connected to an inner side of the $3^{rd}$ grounding terminal 2304, enabling the signal terminals 23 to fit USB/OTG specifications, and a supplementary support unit 24 disposed at two opposite lateral sides relative to the signal terminals 23. The supplementary support unit 24 comprises a first supplementary support rib 241 and a second supplementary support rib 242 respectively outwardly extended from the $2^{nd}$ power terminal 2303 and the $3^{rd}$ grounding terminal 2304, and two resilient retaining rods 243; 244 respectively extended from the first supplementary support rib 241 and the second supplementary support rib 242. The EMI shielding shell 3 further comprises two locating slots 321 respectively located at the first sub shell part 32 for securing the resilient retaining rods 243; 244 of the supplementary support unit 24, enabling the front extension 12 of the electrical insulating terminal holder 1, the signal terminals 23 of the conducting terminal set 2 and the first sub shell part 32 of the EMI shielding shell 3 to fit Micro USB2.0 specifications. Further, the arrangement of the supplementary support unit 24 greatly enhances the structural strength of the front extension 12 and also greatly improves the EMI shielding performance of the electrical connector adapter.

Further, each transmission terminal 22 further comprises a connection portion 225 extending sideways in direction from the mating contact end piece 221 thereof toward the center axis of the electrical insulating terminal holder 1 and connected between the mating contact end piece 221 and the associating horizontally extended signal terminal 23, a first bent 223 connected between the mating contact end piece 221 and the connection portion 225, and a second bent 224 connected between the connection portion 225 and the associating signal terminal 23. Further, the first supplementary support rib 241 and the second supplementary support rib 242 are respectively outwardly extended from the connection portions 225 of the $2^{nd}$ power terminal 2303 and $3^{rd}$ grounding terminal 2304 between the respective first bents 223 and respective second bents 224. Subject to the above-described arrangement, the signal terminals 23 are disposed relatively closer to each other when compared to the arrangement of the conducting terminals 21 and the transmission terminals 22, enabling respective front mating contact segments 231 of the signal terminals 23 to be arranged in the front extension 12 of the electrical insulating terminal holder 1. Further, as stated above, the bonding end pieces 222 of the transmission terminals 22 and the bonding end portions 212 of the conducting terminals 21 are respectively extended out of the rear side of the holder body 11 of the electrical insulating terminal holder 1 and arranged in co-planar relationship with one another. Further, the bonding end portions 212 and the bonding end pieces 222 each have a width gradually increasing in direction away from the holder body 11 to facilitate bonding to a respective metal contact at an external circuit board (not shown), enhancing bonding contact area and signal transmission stability.

Figure 5:
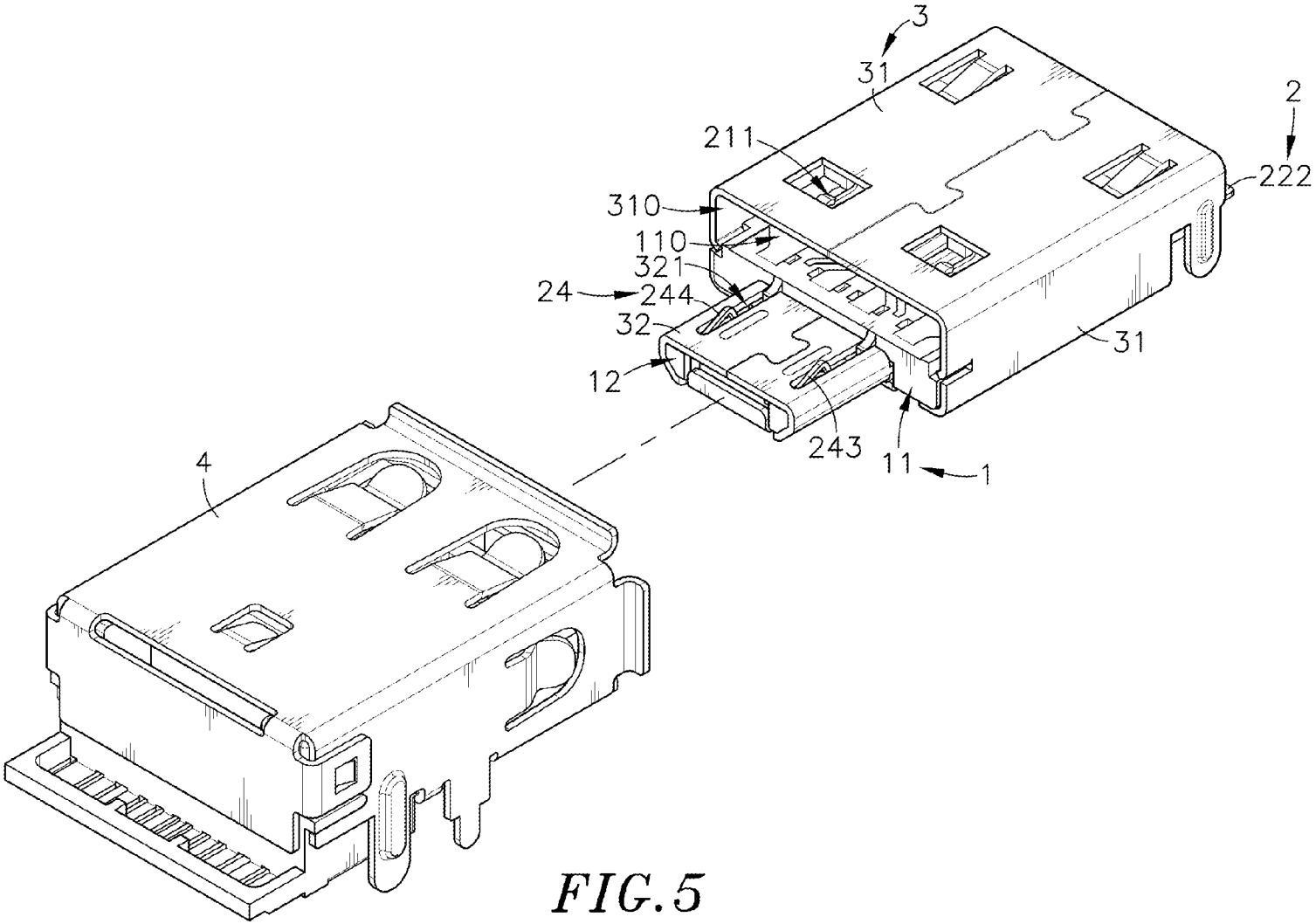
FIG. 5 is a schematic exploded view illustrating an application status of the electrical connector adapter in accordance with the first embodiment of the present invention.
Figure 6:
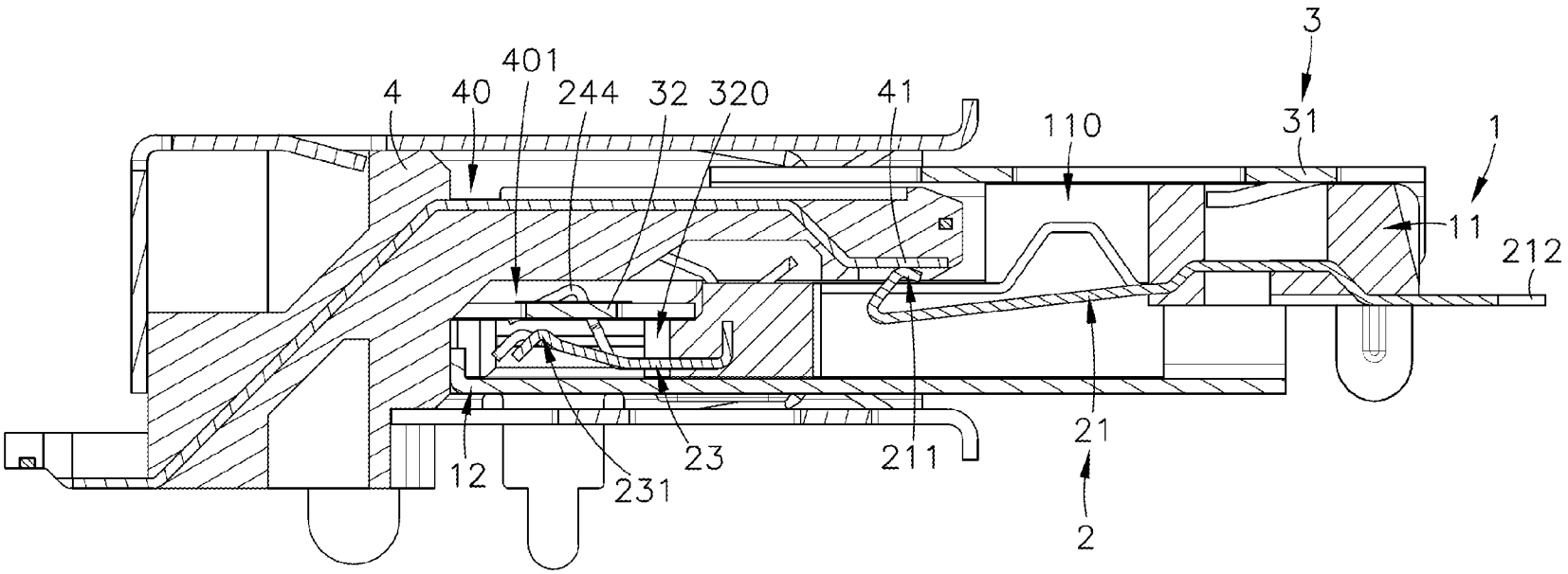
FIG. 6 is a sectional side view illustrating an external electrical connector connected to the electrical connector adapter in accordance with the first embodiment of the present invention.
Figure 7:
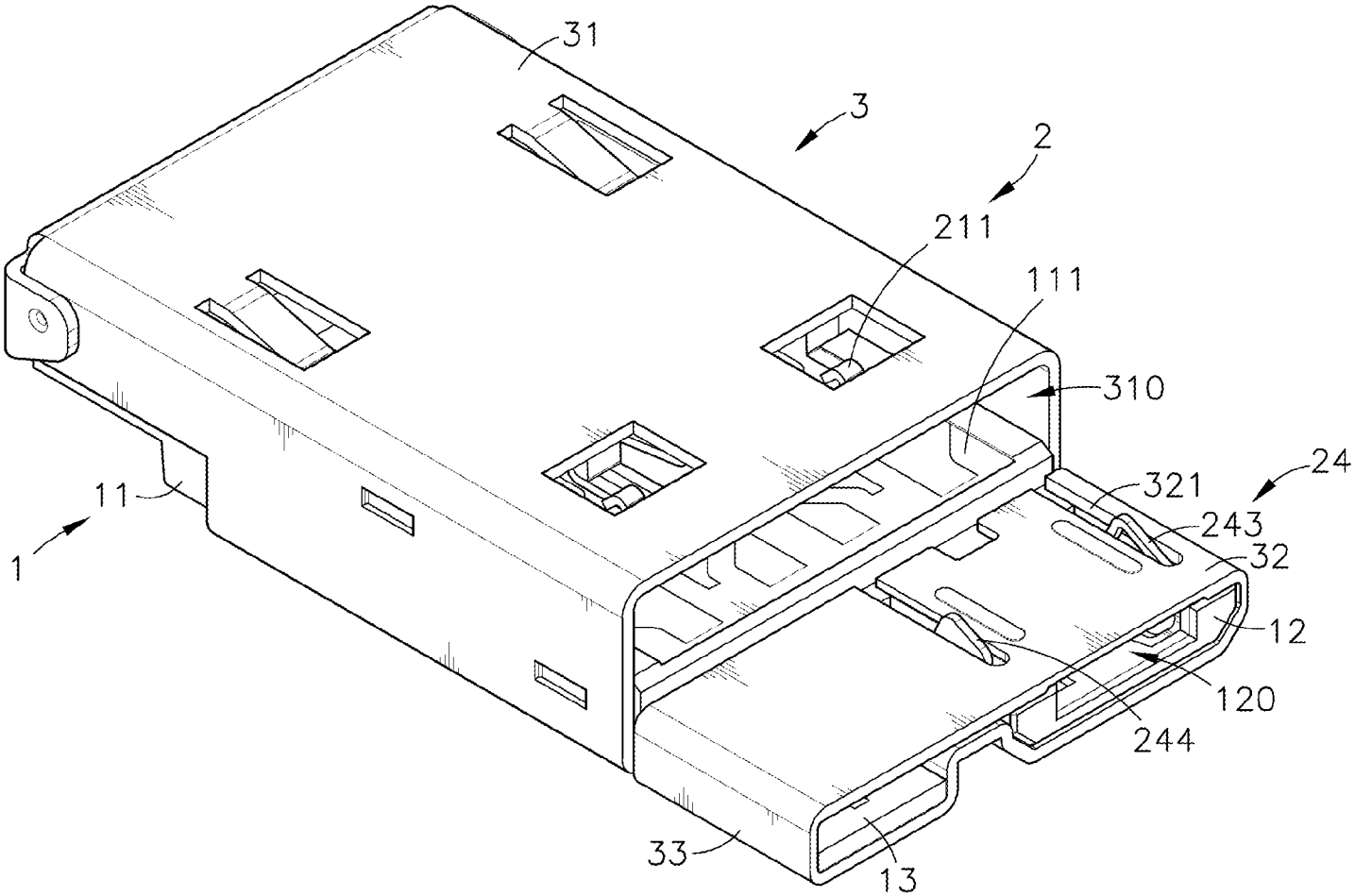
FIG. 7 is an oblique top elevational view of an electrical connector adapter in accordance with a second embodiment of the present invention.
Figure 8:
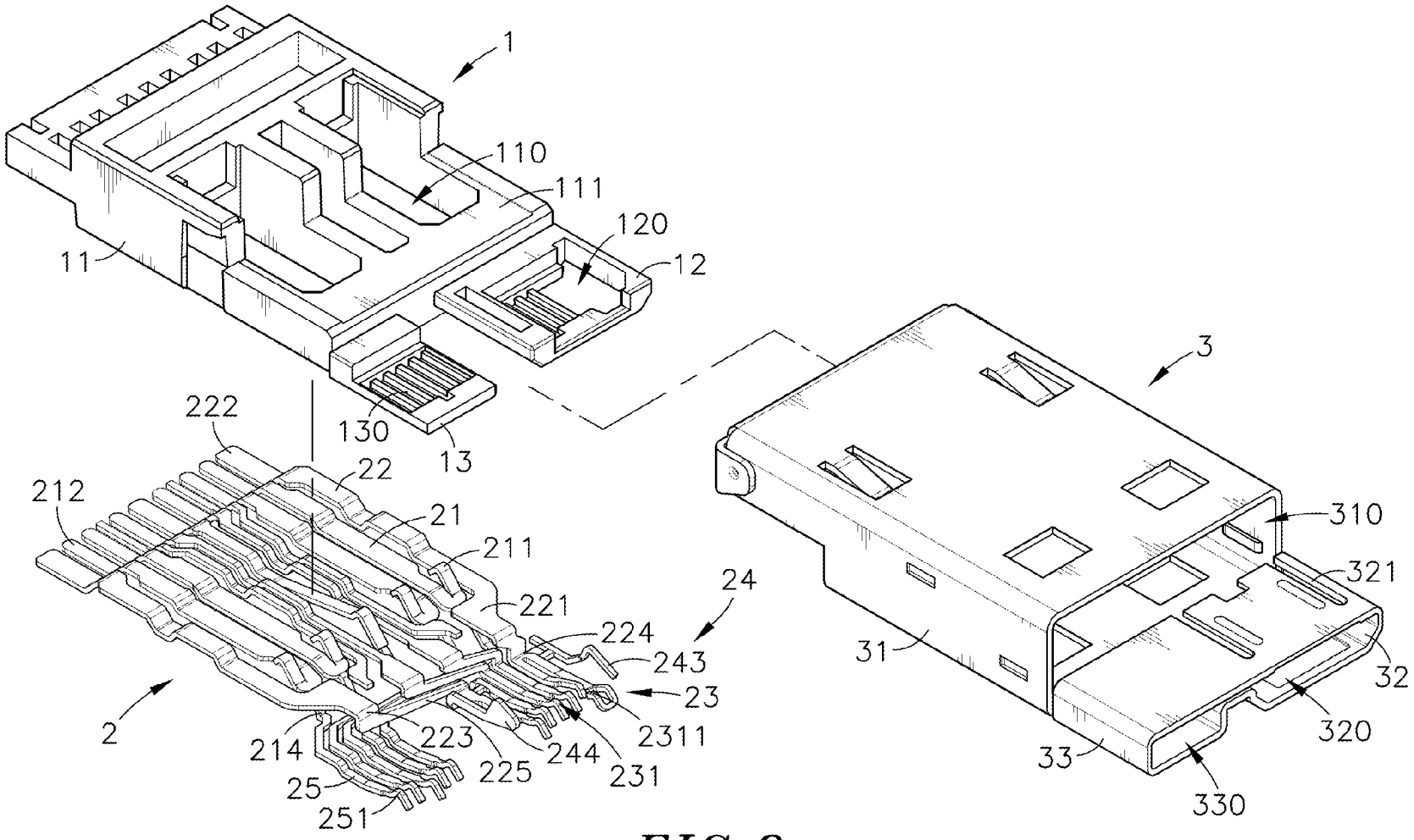
FIG. 8 is an exploded view of the electrical connector adapter in accordance with the second embodiment of the present invention.
Figure 9:
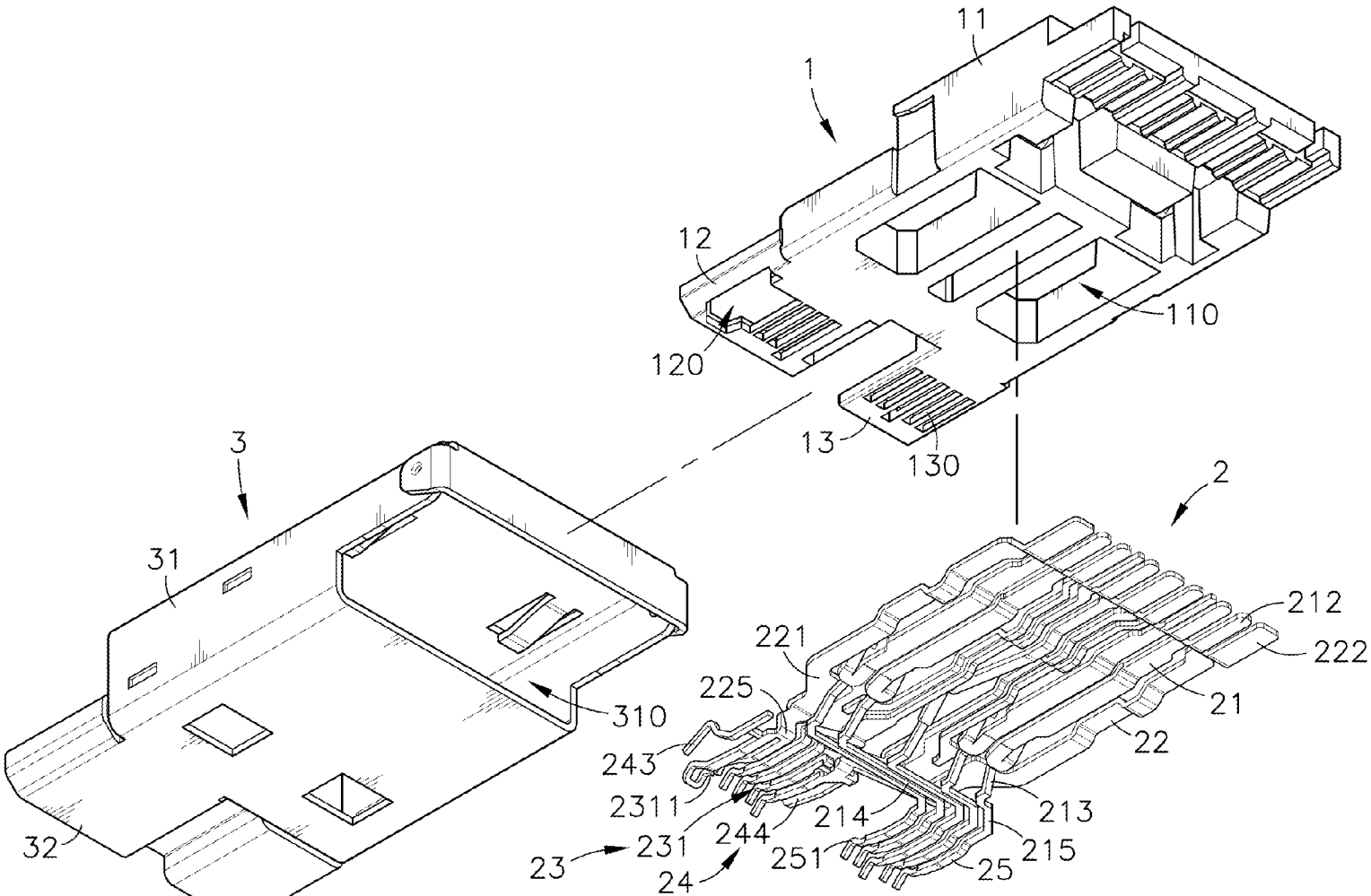
FIG. 9 corresponds to FIG. 8 when viewed from another angle.
Figure 10:
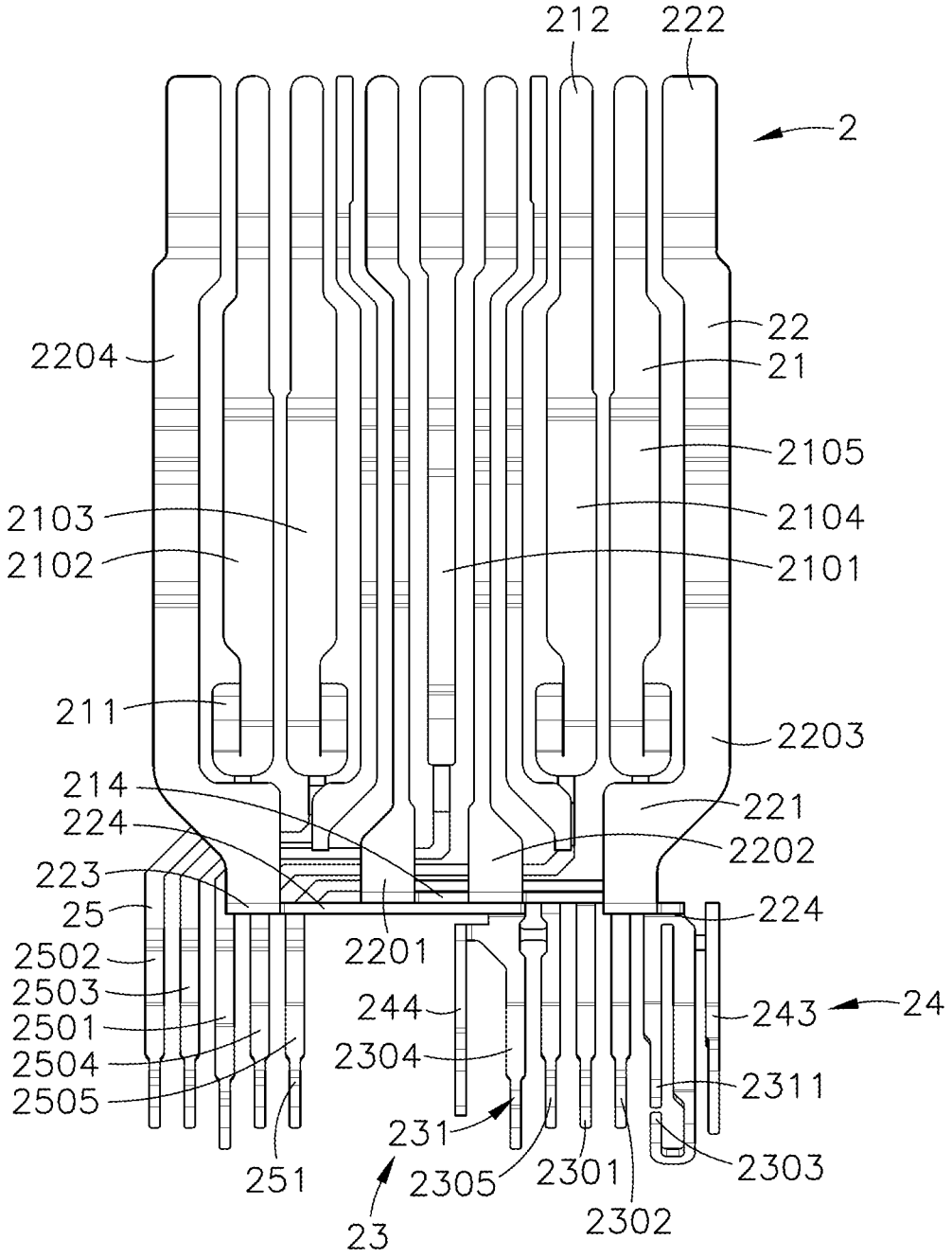
FIG. 10 is a top plain view illustrating the arrangement of the conducting terminal set of the electrical connector adapter in accordance with the second embodiment of the present invention.

Referring to FIGS. 5 and 6 and FIGS. 2 and 3 again, the front extension 12 of the electrical insulating terminal holder 1, the signal terminals 23 of the conducting terminal set 2 and the first sub shell part 32 of the EMI shielding shell 3 are adapted for the connection of, for example, Micro USB2.0 or Mini HDMI connector.

Further, the holder body 11 of the electrical insulating terminal holder 1, the conducting terminals 21 of the conducting terminal set 2 and the main shell part 31 of the EMI shielding shell 3 are adapted for the connection of, for example, a USB3.0, USB2.0 or HDMI connector. When connecting the electrical connector adapter to a mating electrical connector 4, insert the holder body 11 of the electrical insulating terminal holder 1 with the main shell part 31 of the EMI shielding shell 3 into an insertion hole 40 of the mating electrical connector 4 to force the front extension 12 of the electrical insulating terminal holder 1 and the first sub shell part 32 of the EMI shielding shell 3 into an internal receiving chamber 401 in the insertion hole 40. Thus, the front extension 12 of the electrical insulating terminal holder 1 and the sub shell part 32 of the EMI shielding shell 3 do not interfere with the connection between the holder body 11 of the electrical insulating terminal holder 1 and the mating electrical connector 4 for signal transmission. Thus, the electrical connector adapter saves much installation space, facilitates convenient use without causing interference, and provides a wide range of applications.

Referring to FIGS. 7, 8, 9 and 10, an electrical connector adapter in accordance with a second embodiment of the present invention is shown. As illustrated, the electrical connector adapter in accordance with this second embodiment comprises an electrical insulating terminal holder 1, a conducting terminal set 2, and an EMI (electromagnetic interference) shielding shell 3.

The electrical insulating terminal holder 1 comprises a holder body 11, a plurality of elongated openings 110 of different widths cut through opposing top and bottom walls of the holder body 11, an abutment surface 111 disposed at a front side relative to the elongated openings 110, and a front extension 12 and a front tongue 13 forwardly extended from a front side of the holder body 11, an accommodation open space 120 defined in the front extension 12, and a plurality of terminal slots 130 defined in the front tongue 13.

The conducting terminal set 2 comprises a plurality of conducting terminals 21, a plurality of transmission terminals 22, a plurality of signal terminals 23, a supplementary support unit 24, and a plurality of mating terminals 25. Each conducting terminal 21 comprises a mating contact end portion 211 located at a front end thereof, and a bonding end portion 212 located at an opposite rear end thereof. Each transmission terminal 22 comprises a mating contact end piece 221 located at a front end thereof, and a bonding end piece 222 located at an opposite rear end thereof. The conducting terminals 21 are classified as the $1^{st}$ grounding terminal 2101, the $1^{st}$ differential signal terminal 2102, the $2^{nd}$ differential signal terminal 2103, the $3^{rd}$ differential signal terminal 2104 and the $4^{th}$ differential signal terminal 2105, wherein the $1^{st}$ grounding terminal 2101 is arranged on the middle, the $1^{st}$ differential signal terminal 2102 and the $4^{th}$ differential signal terminal 2105 are arranged in parallel at two opposite lateral sides relative to the $1^{st}$ grounding terminal 2101, and the $2^{nd}$ differential signal terminal 2103 and the $3^{rd}$ differential signal terminal 2104 are arranged in parallel and respectively spaced between the $1^{st}$ grounding terminal 2101 and the $1^{st}$ differential signal terminal 2102 and $4^{th}$ differential signal terminal 2105. Further, each conducting terminal 21 comprises a connection arm 214 connected between the mating contact end portion 211 thereof and one respective mating terminal 25, a third bent 213 connected between the mating contact end portion 211 and the connection arm 214, and a fourth bent 215 connected between the connection arm 214 and the respective mating terminal 25. The mating terminals 25 are respectively formed integral with and extended from the fourth bents 215 of the conducting terminals 21 and respectively terminating in a respective curved mating contact section 251. The transmission terminals 22 are classified as the $5^{th}$ differential signal terminal 2201, the $6^{th}$ differential signal terminal 2202, the $1^{st}$ power terminal 2203 and the $2^{nd}$ grounding terminal 2204, wherein the $5^{th}$ differential signal terminal 2201 and the $6^{th}$ differential signal terminal 2202 are arranged in parallel between the $1^{st}$ grounding terminal 2101 and the $2^{nd}$ differential signal terminal 2103 and the $3^{rd}$ differential signal terminal 2104; the $1^{st}$ power terminal 2203 and the $2^{nd}$ grounding terminal 2204 are arranged in parallel at two opposite lateral sides relative to the conducting terminals 21. The signal terminals 23 are respectively extended from the mating contact end pieces 221 of the transmission terminals 22, and classified as the $7^{th}$ differential signal terminal 2301, the $8^{th}$ differential signal terminal 2302, the $2^{nd}$ power terminal 2303 and the $3^{rd}$ grounding terminal 2304, wherein the $7^{th}$ differential signal terminal 2301 and the $8^{th}$ differential signal terminal 2302 are arranged in parallel on the middle; the $2^{nd}$ power terminal 2303 and the $3^{rd}$ grounding terminal 2304 are arranged in parallel at two opposite lateral sides relative to the $7^{th}$ differential signal terminal 2301 and the $8^{th}$ differential signal terminal 2302. Further, each transmission terminal 22 comprises a connection portion 225 extending sideways in direction from the mating contact end piece 221 thereof toward the center axis of the electrical insulating terminal holder 1 and connected between the mating contact end piece 221 and the associating horizontally extended signal terminal 23, a first bent 223 connected between the mating contact end piece 221 and the connection portion 225, and a second bent 224 connected between the connection portion 225 and the associating signal terminal 23. The conducting terminal set 2 further comprises a supplementary transmission terminal 2305 connected to an inner side of the $3^{rd}$ grounding terminal 2304, enabling the signal terminals 23 to fit USB/OTG specifications, and a supplementary support unit 24, which comprises two resilient retaining rods 243; 244 respectively extended from the connection portion 225.

The EMI shielding shell 3 comprises a main shell part 31, a main accommodation chamber 310 defined in the main shell part 31, a first sub shell part 32 and a second sub shell part 33 forwardly extended from a front bottom side of the main shell part 31, a first sub accommodation chamber 320 defined in the sub shell part 32, and a second sub accommodation chamber 330 defined in the second sub shell part 33.

When assembling the electrical connector adapter, mount the conducting terminals 21, the transmission terminals 22, the signal terminals 23, the supplementary support unit 24 and the mating terminals 25 in the electrical insulating terminal holder 1 in such a manner that the mating contact end portions 211 of the conducting terminals 21 are respectively suspended in the elongated openings 110 within the holder body 11, and the bonding end portions 212 of the conducting terminals 21 are respectively extended out of an opposing rear side of the holder body 11; the mating contact end pieces 221 of the transmission terminals 22 are respectively supported on the abutment surface 111, and the bonding end pieces 222 of the transmission terminals 22 are respectively extended out of the rear side of the holder body 11 in co-planar relationship to the bonding end portions 212 of the conducting terminals 21; the front mating contact segments 231 of the signal terminals 23 are respectively suspended in the accommodation open space 120 within the front extension 12; the curved mating contact sections 251 of the mating terminals 25 are respectively positioned in the terminal slots 130 within the front tongue 13. Thereafter, attach the EMI shielding shell 3 to the electrical insulating terminal holder 1 to have the holder body 11, front extension 12 and front tongue 13 of the electrical insulating terminal holder 1 be respectively accommodated in the main accommodation chamber 310 in the main shell part 31, the first sub accommodation chamber 320 in the first sub shell part 32 and the second sub accommodation chamber 330 in the second sub shell part 33. At this time, the electrical insulating terminal holder 1, the conducting terminal set 2 and the EMI shielding shell 3 are assembled together, wherein the holder body 11 of the electrical insulating terminal holder 1, the conducting terminals 21 of the conducting terminal set 2 and the main shell part 31 of the EMI shielding shell 3 constitute a predetermined electrical connector (for example, USB3.0 connector); the holder body 11 of the electrical insulating terminal holder 1, the transmission terminals 22 of the conducting terminal set 2 and the main shell part 31 of the EMI shielding shell 3 constitute another predetermined electrical connector (for example, USB2.0 or HDMI connector); the front extension 12 of the electrical insulating terminal holder 1, the signal terminals 23 of the conducting terminal set 2 and the first sub shell part 32 of the EMI shielding shell 3 constitute still another predetermined electrical connector (for example, Micro USB or Mini HDMI connector); the front tongue 13 of the electrical insulating terminal holder 1, the mating terminals 25 of the conducting terminal set 2 and the second sub shell part 33 of the EMI shielding shell 3 constitute a yet further predetermined electrical connector (for example, Micro USB3.0 connector).

Further, the widths and heights of the front extension 12 and front tongue 13 of the electrical insulating terminal holder 1 are relatively smaller than the width and height of the holder body 11. The widths and heights of the first sub shell part 32 and second sub shell part 33 of the EMI shielding shell 3 are relatively smaller than the width and height of the main shell part 31 of the EMI shielding shell 3. The main shell part 31, first sub shell part 32 and second sub shell part 33 of the EMI shielding shell 3 are respectively configured to fit the holder body 11, front extension 12 and front tongue 13 of the electrical insulating terminal holder 1. Thus, the holder body 11 of the electrical insulating terminal holder 1, the conducting terminals 21 of the conducting terminal set 2 and the main shell part 31 of the EMI shielding shell 3 can constitute a predetermined electrical connector (for example, USB3.0 connector); the abutment surface 111 of the holder body 11 of the electrical insulating terminal holder 1, the transmission terminals 22 of the conducting terminal set 2 and the main shell part 31 of the EMI shielding shell 3 can constitute another predetermined electrical connector (for example, USB2.0 or HDMI connector); the front extension 12 of the electrical insulating terminal holder 1, the signal terminals 23 of the conducting terminal set 2 and the first sub shell part 32 of the EMI shielding shell 3 can constitute still another predetermined electrical connector (for example, Micro USB2.0 or Mini HDMI connector); the front tongue 13 of the electrical insulating terminal holder 1, the mating terminals 25 of the conducting terminal set 2 and the second sub shell part 33 of the EMI shielding shell 3 can constitute a yet further predetermined electrical connector (for example, Micro USB3.0 connector).

Further, in this embodiment, the main shell part 31, first sub shell part 32 and second sub shell part 33 of the EMI shielding shell 3 are integrally made in one piece. Alternatively, the main shell part 31, the first sub shell part 32 and the second sub shell part 33 can be separately made, and then bonded together by using a soldering, high frequency welding or spot gluing technique.

Figure 11:
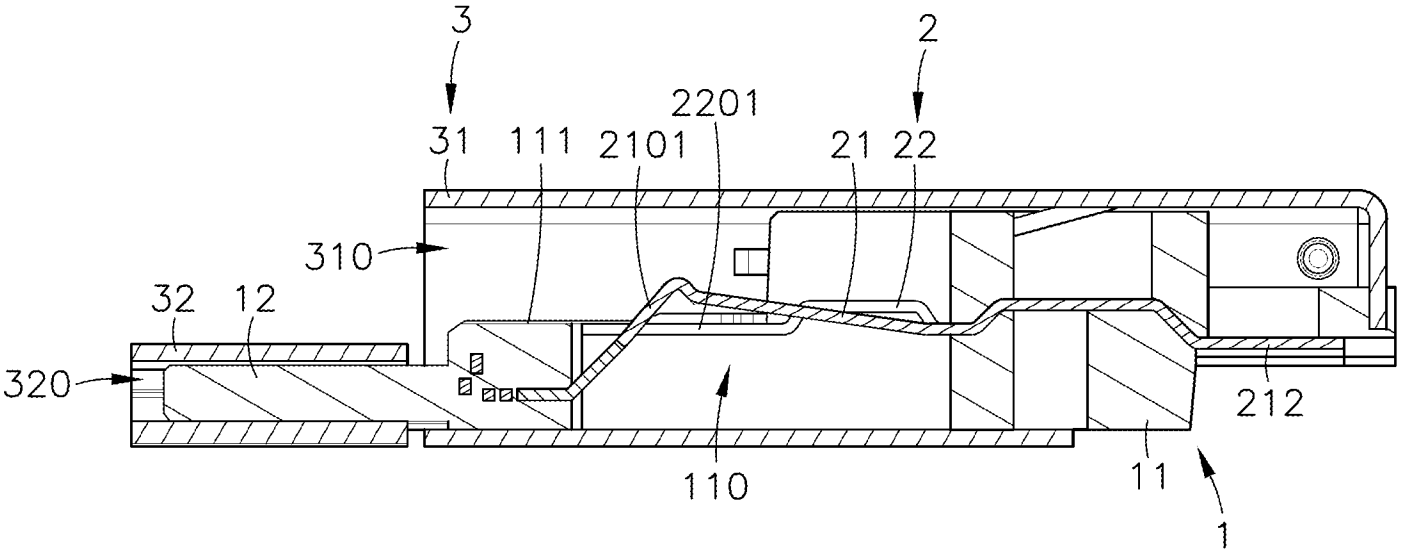
FIG. 11 is a sectional side view of the conducting terminal set of the electrical connector adapter in accordance with the second embodiment of the present invention.
Figure 12:
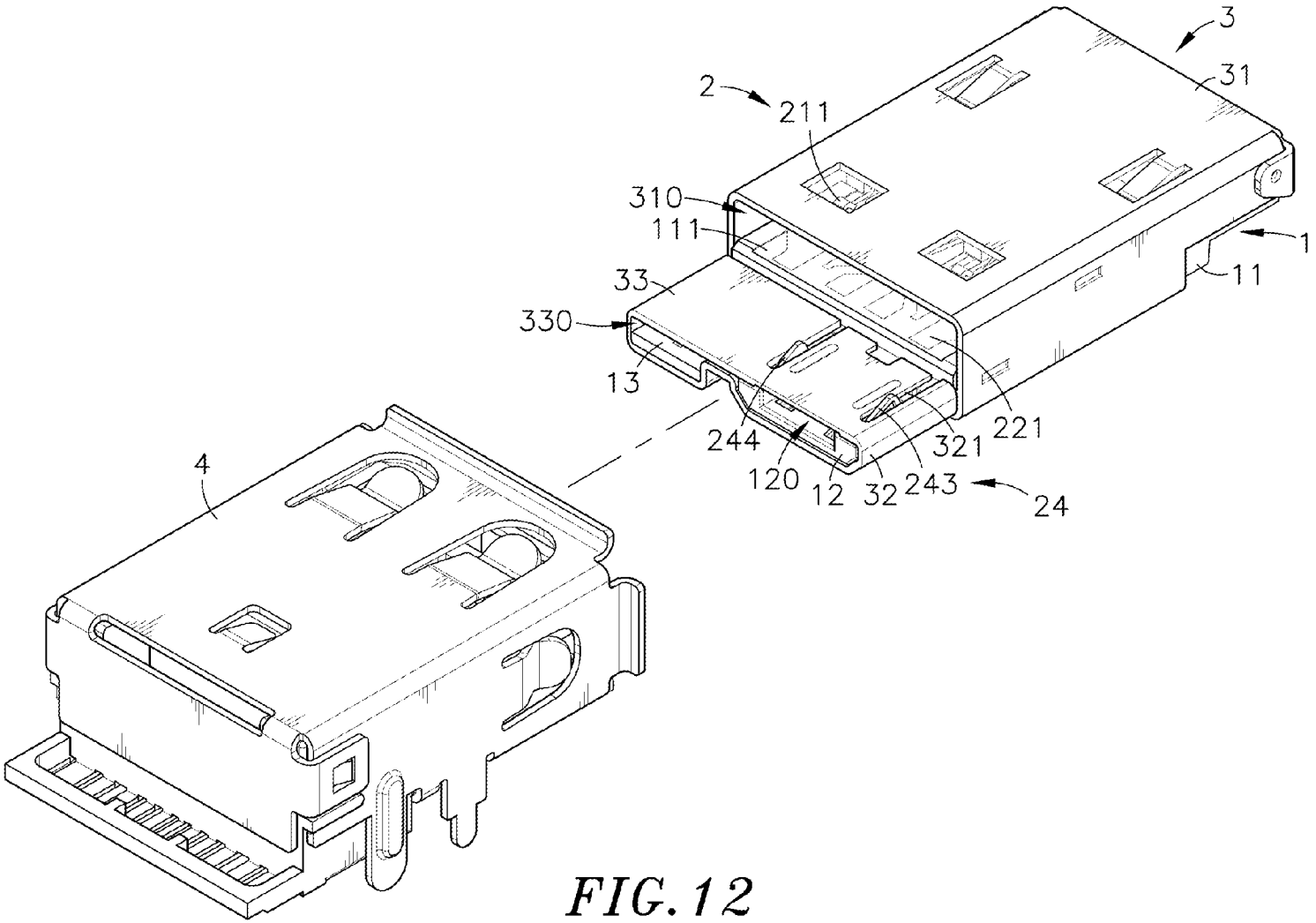
FIG. 12 is a schematic exploded view illustrating an application status of the electrical connector adapter in accordance with the second embodiment of the present invention.

Referring to FIG. 11 and FIGS. 8-10 again, as stated above, the conducting terminal set 2 comprises conducting terminals 21, transmission terminals 22, signal terminals 23, a supplementary support unit 24 and mating terminals 25. The 5 pcs of conducting terminals 21 are classified as the $1^{st}$ grounding terminal 2101, the $1^{st}$ differential signal terminal 2102, the $2^{nd}$ differential signal terminal 2103, the $3^{rd}$ differential signal terminal 2104 and the $4^{th}$ differential signal terminal 2105, wherein the $1^{st}$ grounding terminal 2101 is arranged on the middle, the $1^{st}$ differential signal terminal 2102 and the $4^{th}$ differential signal terminal 2105 are arranged in parallel at two opposite lateral sides relative to the $1^{st}$ grounding terminal 2101, and the $2^{nd}$ differential signal terminal 2103 and the $3^{rd}$ differential signal terminal 2104 are arranged in parallel and respectively spaced between the $1^{st}$ grounding terminal 2101 and the $1^{st}$ differential signal terminal 2102 and $4^{th}$ differential signal terminal 2105. The 4 pcs of transmission terminals 22 are classified as the $5^{th}$ differential signal terminal 2201, the $6^{th}$ differential signal terminal 2202, the $1^{st}$ power terminal 2203 and the $2^{nd}$ grounding terminal 2204, wherein the $5^{th}$ differential signal terminal 2201 and the $6^{th}$ differential signal terminal 2202 are arranged in parallel at two opposite lateral sides relative to the $1^{st}$ grounding terminal 2101 and between the $2^{nd}$ differential signal terminal 2103 and the $3^{rd}$ differential signal terminal 2104; the $1^{st}$ power terminal 2203 and the $2^{nd}$ grounding terminal 2204 are arranged in parallel at two opposite lateral sides relative to the conducting terminals 21 and the $5^{th}$ differential signal terminal 2201 and $6^{th}$ differential signal terminal 2202.

Further, the mating terminals 25 are respectively formed integral with and extended from the fourth bents 215 of the respective conducting terminals 21 and respectively terminating in a respective curved mating contact section 251, i.e., the number of the mating terminals 25 is 5, and the 5 pcs of mating terminals 25 are classified as the $4^{th}$ grounding terminal 2501 disposed on the middle, the $9^{th}$ differential signal terminal 2502 and the $12^{th}$ differential signal terminal 2505 arranged in parallel at two opposite lateral sides relative to the $4^{th}$ grounding terminal 2501, and the $10^{th}$ differential signal terminal 2503 and the $11^{th}$ differential signal terminal 2504 arranged in parallel and respectively spaced between the $4^{th}$ grounding terminal 2501 and the $9^{th}$ differential signal terminal 2502 and $12^{th}$ differential signal terminal 2505. The 4 pcs of signal terminals 23 are respectively extended from the mating contact end pieces 221 of the transmission terminals 22, and classified as the $7^{th}$ differential signal terminal 2301, the $8^{th}$ differential signal terminal 2302, the $2^{nd}$ power terminal 2303 and the $3^{rd}$ grounding terminal 2304. The $7^{th}$ differential signal terminal 2301 and the $8^{th}$ differential signal terminal 2302 are arranged in parallel on the middle. The $2^{nd}$ power terminal 2303 and the $3^{rd}$ grounding terminal 2304 are arranged in parallel at two opposite lateral sides relative to the $7^{th}$ differential signal terminal 2301 and the $8^{th}$ differential signal terminal 2302. The conducting terminal set 2 further comprises a supplementary transmission terminal 2305 connected to an inner side of the $3^{rd}$ grounding terminal 2304, enabling the signal terminals 23 to fit USB/OTG specifications. The first supplementary support rib 241 and second supplementary support rib 242 of the supplementary support unit 24 are respectively outwardly extended from the $2^{nd}$ power terminal 2303 and the $3^{rd}$ grounding terminal 2304. The supplementary support unit 24 further comprises two resilient retaining rods 243; 244 respectively. The EMI shielding shell 3 further comprises two locating slots 321 respectively located at the first sub shell part 32 for securing the resilient retaining rods 243; 244 of the supplementary support unit 24, enabling the front extension 12 of the electrical insulating terminal holder 1, the signal terminals 23 of the conducting terminal set 2 and the first sub shell part 32 of the EMI shielding shell 3 to fit Micro USB2.0 specifications. Further, the arrangement of the supplementary support unit 24 greatly enhances the structural strength of the front extension 12 and also greatly improves the EMI shielding performance of the electrical connector adapter.

Figure 13:
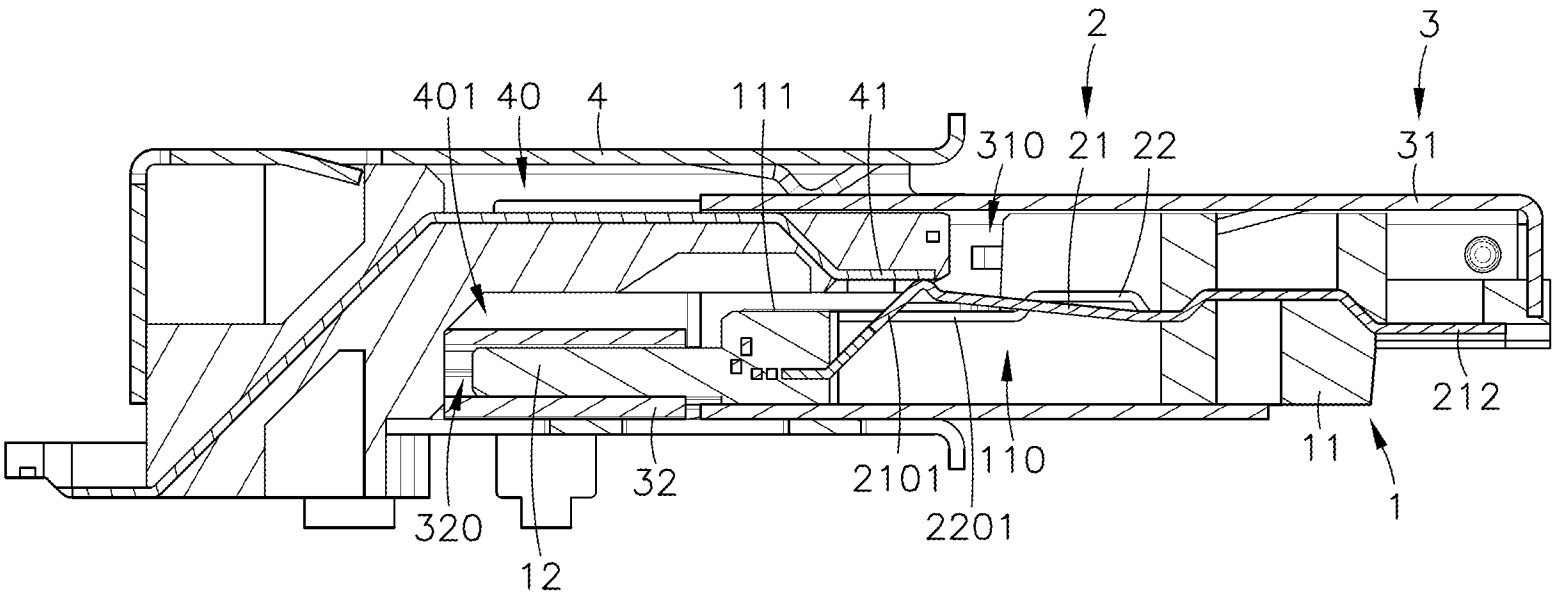
FIG. 13 is a sectional side view illustrating an external electrical connector connected to the electrical connector adapter in accordance with the second embodiment of the present invention.

Referring to FIGS. 12 and 13 and FIGS. 8, 9 and 12 again, during application of the electrical connector adapter of the present invention, the elongated openings 110 in the holder body 11 of the electrical insulating terminal holder 1, the conducting terminals 21 of the conducting terminal set 2 and the main accommodation chamber 310 in the main shell part 31 of the EMI shielding shell 3 constitute a predetermined electrical connector (for example, USB3.0 connector; the abutment surface 111 of the holder body 11 of the electrical insulating terminal holder 1, the mating terminals 25 of the conducting terminal set 2 and the main accommodation chamber 310 in the main shell part 31 of the EMI shielding shell 3 constitute another predetermined electrical connector (for example, USB2.0 or HDMI connector); the front extension 12 of the electrical insulating terminal holder 1, the signal terminals 23 of the conducting terminal set 2 and the first sub shell part 32 of the EMI shielding shell 3 constitute still another predetermined electrical connector (for example, Micro USB2.0 or Mini HDMI connector); the front tongue 13 of the electrical insulating terminal holder 1, the mating terminals 25 of the conducting terminal set 2 and the second sub shell part 33 of the EMI shielding shell 3 constitute a yet further predetermined electrical connector (for example, Micro USB3.0)

In conclusion, the invention provides an electrical connector adapter, which comprises an electrical insulating terminal holder 1 comprising a holder body 11 defining a plurality of elongated openings 110 and an abutment surface 111, a front extension 12 and a front tongue 13, a conducting terminal set 2 comprising a plurality of conducting terminals 21, a plurality of transmission terminals 22, a plurality of signal terminals 23, a supplementary support unit 24 and a plurality of mating terminals 25, and an EMI (electromagnetic interference) shielding shell 3 comprising a main shell part 31, a first sub shell part 32 and a second sub shell part 33, wherein the component parts are configured to selectively fit USB3.0, USB2.0, HDMI, Micro USB3.0, Micro USB2.0 or Mini HDM. Therefore, the electrical connector adapter of the present invention saves much installation space, facilitates convenient use without causing interference, and provides a wide range of applications.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector adapter, comprising:

an electrical insulating terminal holder comprising a holder body defining opposing front side and rear side, a plurality of elongated openings cut through opposing top and bottom walls of said holder body, a front extension forwardly extended from a lower part of the front side of said holder body and an accommodation open space defined in said front extension, said front extension being configured relatively smaller than said holder body in width and height;

a conducting terminal set mounted in said electrical insulating terminal holder, said conducting terminal comprising a plurality of conducting terminals and a plurality of transmission terminals, each said conducting terminal comprising a mating contact end portion located at a front end thereof and suspending in one said elongated opening and a bonding end portion located at an opposite rear end thereof and extended out of the rear side of said holder body, each said transmission terminal comprising a mating contact end piece located at a front end thereof and suspending in said accommodation open space of said electrical insulating terminal holder and a bonding end piece located at an opposite rear end thereof and extended out of the rear side of said holder body; and an EMI shielding shell surrounding said electrical insulating terminal holder, said EMI shielding shell comprising a main shell part, a main accommodation chamber defined in said main shell part and accommodating said holder body of said electrical insulating terminal holder, a first sub shell part forwardly extended from a front bottom side of said main shell part and a first sub accommodation chamber defined in said first sub shell part and accommodating said front extension of said electrical insulating terminal holder, said first sub shell part being configured relatively smaller than said main shell part in width and height;

wherein said conducting terminals and said transmission terminals are configured to fit USB3.0/USB2.0 and Micro USB3.0/Micro USB2.0, or, HDMI and Mini HDMI, or, USB3.0/USB2.0 and Mini USB3.0/Mini USB2.0 specifications.

2. The electrical connector adapter as claimed in claim 1, wherein said holder body of said electrically insulative terminal holder is configured to fit one of USB3.0, USB2.0 and HDMI specifications.

3. The electrical connector adapter as claimed in claim 1, wherein said front extension of said electrical insulating terminal holder is configured to fit one of Micro USB3.0, Micro USB2.0 and Mini HDMI specifications.

4. The electrical connector adapter as claimed in claim 1, wherein said conducting terminal set further comprises a plurality of signal terminals respectively extended from said transmission terminals and a supplementary support unit adapted to support said transmission terminals in said electrical insulating terminal holder; each said transmission terminal further comprises a connection portion extending sideways in direction from the mating contact end piece thereof toward the center axis of said electrical insulating terminal holder and connected between the mating contact end piece and the associating said signal terminal, a first bent connected between the mating contact end piece and said connection portion, and a second bent connected between said connection portion and the associating said signal terminal; said supplementary support unit comprises a first supplementary support rib and the second supplementary support rib respectively outwardly extended from the connection portions of two said transmission terminals between the respective first bents and respective second bents.

5. An electrical connector adapter, comprising:

an electrical insulating terminal holder comprising a holder body defining opposing front side and rear side, a plurality of elongated openings of different widths cut through opposing top and bottom walls of said holder body, an abutment surface disposed at a front side relative to said elongated openings, a front extension and a front tongue forwardly extended from the front side of said holder body, an accommodation open space defined in said front extension and a plurality of terminal slots defined in said front tongue, said front extension and said front tongue being relatively smaller than said holder body in width and height;

a conducting terminal set mounted in said electrical insulating terminal holder, said conducting terminal comprising a plurality of conducting terminals, a plurality of transmission terminals, a plurality of signal terminals and a plurality of mating terminals, each said conducting terminal comprising a mating contact end portion located at a front end thereof and suspending in one said elongated opening of said electrically insulating terminal holder and a bonding end portion located at an opposite rear end thereof and extended out of the rear side of said holder body, each said transmission terminal comprising a mating contact end piece located at a front end thereof and supported on said abutment surface of said electrical insulating terminal holder and a bonding end piece located at an opposite rear end thereof and extended out of the rear side of said holder body, said signal terminals being respectively extended from said transmission terminals and terminating in a front mating contact segment, the front mating contact segments of said signal terminals being suspended in said accommodation open space in said front extension, said mating terminals being respectively formed integral with and extended from said conducting terminals and respectively terminating in a respective curved mating contact section, the curved mating contact sections of said mating terminals being respectively suspended in said terminal slots in said front tongue; and an EMI shielding shell surrounding said electrical insulating terminal holder, said EMI shielding shell comprising a main shell part, a main accommodation chamber defined in said main shell part and adapted for accommodating said holder body of said electrical insulating terminal holder, a first sub shell part and a second sub shell part forwardly extended from a front bottom side of said main shell part, a first sub accommodation chamber defined in said sub shell part and adapted for accommodating said front extension of said electrical insulating terminal holder, and a second sub accommodation chamber defined in said second sub shell part and adapted for accommodating said front tongue of said electrical insulating terminal holder; wherein said conducting terminals and said signal terminals are configured to fit USB3.0 and Mini USB3.0, or, HDMI and mini HDMI specifications.

6. The electrical connector adapter as claimed in claim 5, wherein said holder body of said electrically insulative terminal holder is configured to fit one of USB3.0, USB2.0 and HDMI specifications.

7. The electrical connector adapter as claimed in claim 5, wherein said front extension of said electrical insulating terminal holder is configured to fit one of Micro USB3.0, Micro USB2.0 and Mini HDMI specifications.

8. The electrical connector adapter as claimed in claim 5, wherein each said conducting terminal comprises a connection arm connected between the mating contact end portion thereof and one respective said mating terminal, a third bent connected between the mating contact end portion and said connection arm, and a fourth bent connected between said connection arm and the associating said mating terminal.

9. The electrical connector adapter as claimed in claim 5, wherein said conducting terminal set further comprises a supplementary support unit adapted to support said transmission terminals in said electrical insulating terminal holder; each said transmission terminal further comprises a connection portion extending sideways in direction from the mating contact end piece thereof toward the center axis of said electrical insulating terminal holder and connected between the mating contact end piece and the associating said signal terminal, a first bent connected between the mating contact end piece and said connection portion, and a second bent connected between said connection portion and the associating said signal terminal; said supplementary support unit comprises a first supplementary support rib and the second supplementary support rib respectively outwardly extended from the connection portions a two said transmission terminals between the respective first bents and respective second bents.

10. The electrical connector adapter as claimed in claim 9, wherein said conducting terminals and said transmission terminals are configured to fit USB2.0 and Micro USB2.0, or, HDMI and Mini HDMI specifications.

* * * * *